United States Patent [19]

Brooks, Jr.

[11] 4,211,180

[45] Jul. 8, 1980

[54] COMPENSATING TROLLING FIN

[76] Inventor: James C. Brooks, Jr., 2108 S. Kathleen, Jonesboro, Ark. 72401

[21] Appl. No.: 921,313

[22] Filed: Jul. 3, 1978

[51] Int. Cl.[2] ..... B63H 25/00

[52] U.S. Cl. ..... 114/144 R; 114/162; 115/18 A

[58] Field of Search ..... 114/128, 132, 144 R, 114/145 A, 152, 153, 162, 165, 168; 115/17, 18 R, 18 A, 18 E; 248/225.3 R, 226.4

[56] References Cited

U.S. PATENT DOCUMENTS

| | | | |
|---|---|---|---|
| 2,972,977 | 2/1961 | Hausmann | 115/17 X |
| 3,724,790 | 4/1973 | Harris et al. | 115/17 X |
| 3,728,983 | 4/1973 | Ingham | 114/162 |
| 3,828,718 | 8/1974 | Jolin | 115/18 R |
| 4,008,677 | 2/1977 | Wordell | 114/165 X |

*Primary Examiner*—George E. A. Halvosa
*Attorney, Agent, or Firm*—Stephen D. Carver

[57] ABSTRACT

A drift compensating trolling fin adapted to be secured to the transom of a boat. The transom comprises a generally J-shaped frame of channel construction, a preferably two piece, pivoted linkage arm coupled to the frame and snugly receivable within the frame channel, a blade secured to the linkage for deployment in the water to resist drifting, and a slot defined within the frame for snugly receiving a portion of the blade to reinforce the trolling fin when the blade is deployed.

2 Claims, 7 Drawing Figures

6.
6.

COMPENSATING TROLLING FIN

BACKGROUND OF THE INVENTION

This invention relates generally to a rudder accessory which may be quickly attached to a transom of a boat to minimize drifting caused by currents in the water. More particularly, the present invention relates to a trolling fin accessory for stabilizing boats when electric trolling motors are in use.

In recent years electric trolling motors have become increasingly popular with fishermen. Trolling motors generally comprise a submergeable electrically operated propeller mechanism which may be steered by the fisherman to slowly propel the fishing boat to the desired location. Usually storage batteries are employed to supply electric power, and trolling motors are usually fastened to the front of the boat. As will be recognized by fishermen skilled in the art, the electric trolling motor is usually employed to move from point to point along a desired fishing spot, for example, after the large gasoline powered outboard motor has driven the boat from the landing (or other remote distant location) to the intended fishing area. Before switching to electric motor operation it has become increasingly common to tilt the outboard motor such that the propeller and lower unit thereof will be removed from the water to decrease drag. As will be readily appreciated, the more drag can be reduced the longer the electric trolling motor batteries will last. In part because of the latter factor, modern outboard motors may be provided with electric tilt mechanisms so that they may be lifted out of the water by the fisherman simply by pushing a button or activator mechanism near his control point.

Once the lower unit and propeller portions of the outboard motor are removed from the water the rear of the vessel or boat may become unstable in response to strong currents or winds. Accordingly, it is apparent that means for increasing lateral stability would seem desirable to prevent moving of the tail of the boat in response to water currents. Such an assembly should not add to the drag which must be overcome by the front electric trolling motor. Additionally, since the outboard motor may be quickly re-engaged to travel across the lake upon a moment's notice, an accessory stabilizer fin or blade should be quickly disengageable.

In the prior art a variety of rudder assemblies or stabilizer blades are known. Steerable accessory rudders for watercraft are illustrated in U.S. Pat. Nos. 2,522,653; 3,221,699; and 4,008,677. Each of the devices illustrated by the known prior art is adapted to provide steering for the vessel, and consequently the rudder portion is adapted to pivot in the water relative to the boat to vary the desired steering angle. However, as previously discussed, where an electric trolling motor is employed by the fisherman, steering control is principally accomplished by the trolling motor. U.S. Pat. Nos. 1,107,408 and 2,956,533 illustrate accessory rudder attachments adapted to be secured to outboard motors.

SUMMARY OF THE INVENTION

The present invention comprises an accessory trolling fin or blade adapted to be secured to a boat for preventing or minimizing the drift which may otherwise be experienced by the fisherman when powering his boat only with an electric trolling motor.

The trolling fin comprises a generally J-shaped frame rigid, channel construction. A "hook" portion of the frame is adapted to be clamped or secured to the transom of the boat, so that an elongated channel portion will extend vertically downwardly parallel to the vessel transom. Linkage apparatus pivotally attached to the frame snugly nests within the frame channel. The linkage means is rigidly secured to a blade or rudder which may be deployed in the water as desired by the fisherman to stabilize the rear end of the boat. The frame includes a slot defined therewithin for receiving a portion of the blade to resist tortional forces caused by currents in the water. Reinforcement means are provided to lock the blade into a position substantially perpendicular to the transom to resist tortional forces from currents or winds.

The linkage which couples the blade to the frame perferably comprises two separate sections which are pivotally coupled together so that the blade may be swung out of the water and over the transom into a storage position substantially within the rear of the boat. Importantly, folding of the trolling fin into the storage position will prevent interference to the fisherman while fishing or casting, etc., and it prevents interference with the outboard (or other) drive motor. In a preferred embodiment of this invention a pair of plates are rigidly secured to the trolling fin frame on opposite sides of the slot for further reinforcing the trolling fin by engaging a portion of the blade when deployed. Standoff structure is preferably employed to prevent contact between apparatus frame and the boat's transom. Additionally, manually operable means are provided for selectably fastening the trolling fin to the transom as desired by the fisherman. A cable may be attached between the rear of the blade and a bearing at the upper portion of the frame for manually removing the blade from water as desired.

Thus an object of the invention is to provide a trolling fin assembly for stabilizing boats from drifting and the like.

A similar object of the invention is to provide a trolling fin assembly of the character described which will be rigidly maintained in a substantially perpendicular position relative to the transom when in use to minimize drifting of the boat otherwise caused by winds and currents.

Another object of this invenion is to provide a trolling fin or rudder assembly adapted for use with electric trolling motors.

A similar object of this invention is to provide a means whereby a vessel operating only with a front mounted electric trolling motor may be stabilized in the rear when the larger outboard drive motor has been tilted out of the water.

A similar object of this invention is to provide a rudder assembly of the character described which is extremely resistent to lateral or tortional forces.

Still another object of this invention is to provide a rudder or stabilizer blade of the character described which may be easily disengaged from the deployed position into an out-of-the-way folded position substantially within the boat.

Yet another object of this invention is to provide an accessory stabilizer blade of the type described which will not be damaged when accidentally engaging underwater obstacles. It is a feature of this invention that the apparatus is strongly resistant to lateral or tortional forces, while it will quickly release itself (and thereby prevent damage) in response to contact with underwater obstacles.

A still further object of this invention is to provide a trolling fin structure of the character described ideally adapted for flat bottom river boats, john boats or the like.

These and other objects and advantages of this invention, along with features of novelty appurtenant thereto, will appear or become apparent in the course of the following description.

BRIEF DESCRIPTION OF THE DRAWINGS

In the following drawings, which form a part of the specification and which are to be construed in conjunction therewith, and in which like reference numerals have been employed throughout to indicate like parts in the various views:

FIG. 5 is a rear or end view of the invention with parts thereof broken away for clarity, as viewed generally from the left of FIG. 2;

DETAILED DESCRIPTION OF THE DRAWINGS

Figure 1:
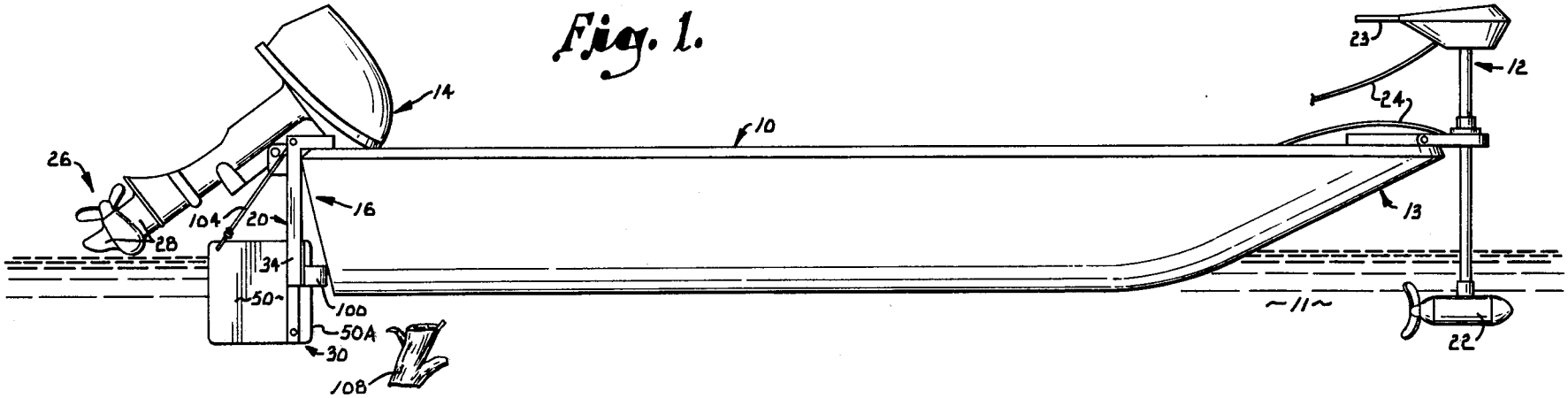
FIG. 1 is a side elevational view of a fishing boat on which the instant invention has been operably mounted.

In FIG. 1 a conventional fishing boat 10 afloat in water 11 includes a conventional front or bow-mounted electric trolling motor 12 and a typical gasoline-driven outboard motor 14 mounted at the stern 16 over the transom 18 thereof. The drift-resistant trolling fin 20 comprising the instant invention is shown mounted to the vessel stern adjacent outboard motor 14 for stabilizing the boat against water currents and winds.

As will be appreciated by those skilled in the art, the electric trolling motor 12 includes a lower propulsion unit 22 which when actuated will pull the fishing boat in the desired direction. The trolling motor includes a handle 23 which may be grasped to facilitate desired steering, or alternatively steering may be effectuated through a pair of control cables 24 which may be linked to conventional foot control apparatus (not shown). When fishing with an electric motor it is desirable to tilt the outboard motor 14 so that the lower unit 26 thereof substantially clears the water 11 to minimize drag forces which must be overcome by the battery-powered trolling motor.

Outboard motor 14 includes a conventional lower rudder portion 28 which, when deployed in water, aids in steering and control of the boat. However, with motor 14 tilted out of the water it will be apparent that control of the rear of the vessel in response to currents and the like is substantially minimal. By attaching the invention 20 to the boat as illustrated, the stern of the vessel will become substantially resistant to forces produced by winds and/or water currents. However, as will be discussed later in conjunction with FIG. 6, the narrow lower portion 30 of the trolling fin presents only minimal drag force to the motor 22, unlike the massive lower unit portion 26 of outboard motor 14.

Figure 4:
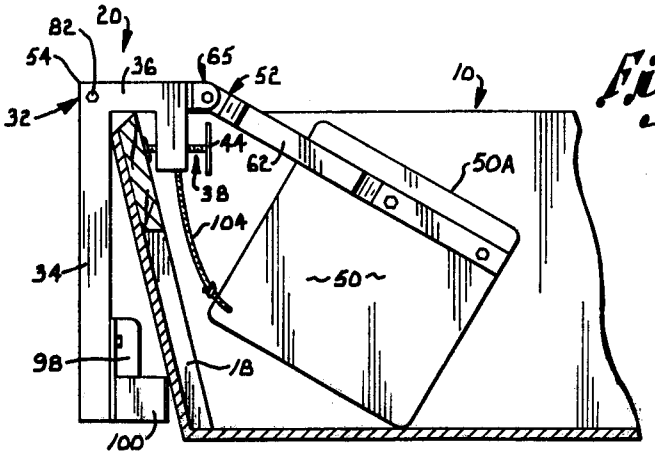
FIG. 4 is a view with parts thereof broken away or shown in section for clarity and illustrating the invention deployed in a transportable, out-of-the-way position within the boat.

Referring now to FIGS. 2 and 5–7, the drift resisting trolling fin 20 comprises a generally J-shaped frame 32 of preferably metallic, channel construction. Frame 32 includes a vertically oriented elongated channel portion 34, which is adapted to hang outside the stern of the boat 10, and an upper hook shaped portion 36 preferably integral with frame portion 34 which is adapted to secure the trolling fin to the stern of the vessel (FIG. 4). It will be observed that the hook portion 36 of frame 32 is provided with a generally T-shaped, manually actuable screw-type fastener 38 which is received through a nut 40 secured within hook portion 36 and which includes a washer portion 42 for compressing the stern of the vessel between the hook portion 36 and the facing portion of the lower frame 34 to thereby wedge the trolling fin in place stationary on top of the vessel stern. A handle 44 may be welded to the shaft 45 of the screw means so that the user may quickly manually install and or remove the invention.

A blade 50 of generally rectangular dimensions is adapted to be deployed within the water to increase the lateral stability of the vessel 10. Blade 50 is pivotally coupled to frame 32 via linkage means 52 which extends between blade 50 and an upper apex 54 of the frame 32.

Figure 3:
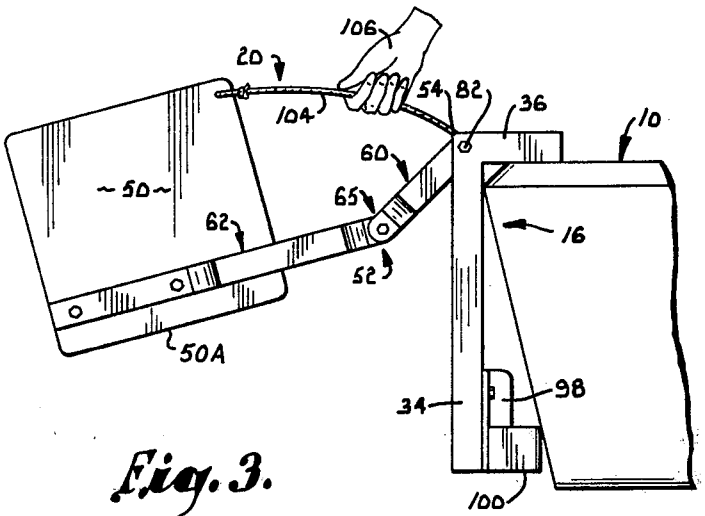
FIG. 3 is an elevational, diagrammatic view showing the invention in use with the blade portion in an intermediate withdrawn position.

As best viewed in FIGS. 3 through 5 the linkage means 52 preferably comprises an upper or first elongated channel section 60 and a lower or second elongated linkage section 62 which are pivotally coupled to each other by a bearing means 65. In the preferred embodiment the lower linkage means section 62 actually comprises a pair of spaced apart, elongated parallel braces 63 and 64, the lowermost portions thereof being sandwiched about the blade 50 and maintained in compression by bolt pairs 66 and 67. The intermediate portions of lower linkage means braces 63 and 64 are spaced apart so that the linkage means will be snugly received within the frame channel portion 34. The uppermost portions of the lower linkage means braces 63 and 64 are compressed inwardly somewhat and abut a bearing 70. The upper or first elongated linkage means 60 similarly comprises a pair of spaced apart, elongated parallel braces 73 and 74 (best viewed in FIG. 5) which include lower end portions thereof which are sandwiched about the upper end portions of lower linkage means braces 63 and 64 to form bearing structure 65, and which are maintained in place by a nut and bolt combination 78.

The upper confines 73A and 74A of the first or upper elongated linkage sections are similarly sandwiched about opposite ends of a bearing structure 80, and are held in place by a nut and bolt combination 82 thereby pivotally coupling upper linkage section portion 60 (and thereby the entire linkage assembly) to the upper portion of the vertically elongated frame channel 34. In this manner the entire linkage means may swing out of the frame and up and over the frame hook portion 36 into the stern or rear of the vessel (FIG. 4). To accomplish the latter it has been found desirable to make the length 88 of the upper linkage section 60 approximately equal to or greater than the length 90 of the upper, rearwardly projecting portion 36B of frame hook portion 36. As will be discussed in more detail later in conjunction with FIGS. 3 and 4, the latter linkage means construction facilitates easy removal of the blade 50 from the water into the storage position illustrated in FIG. 4.

Figures 2, 3, 6, 7:
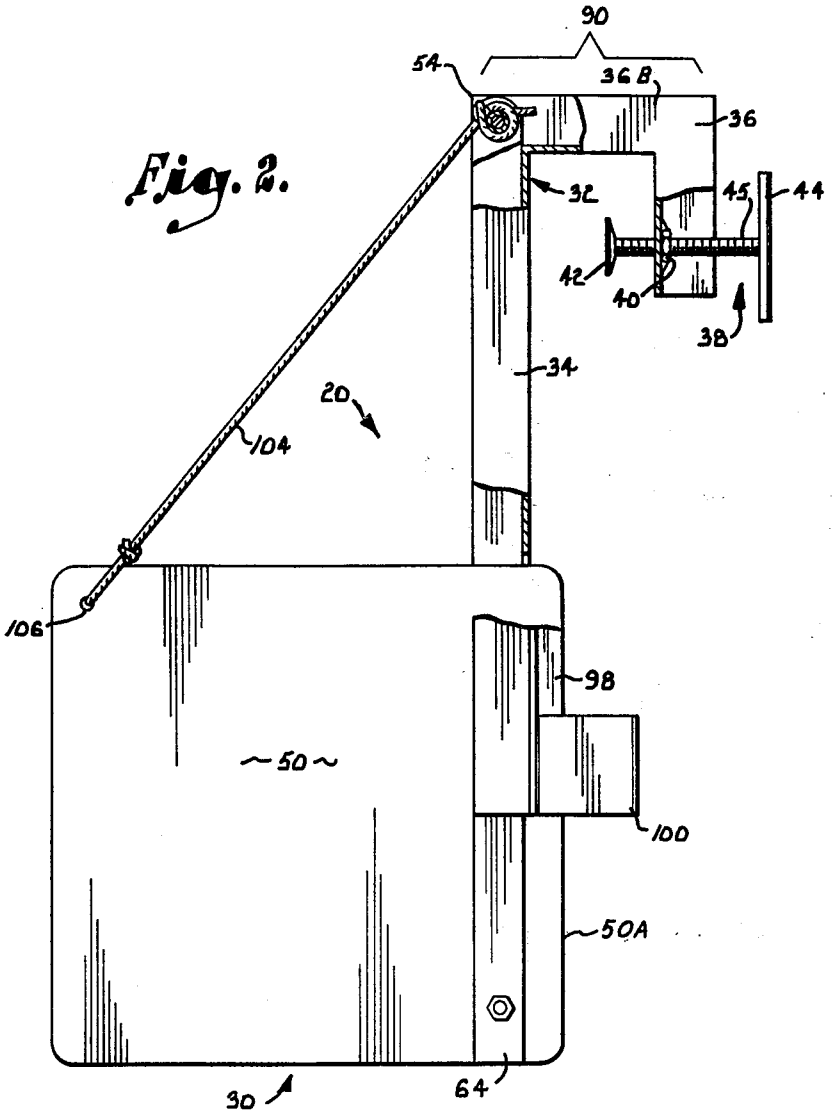
FIG. 2 is an enlarged, side elevational view of the invention, with parts thereof broken away or shown in section for clarity.
FIG. 6 is a sectional view of the invention taken along line 6—6 of FIG. 5 with parts thereof omitted for clarity, illustrating the blade slot and reinforcement means.
FIG. 7 is a sectional view similar to FIG. 6 in which the trolling blade has been folded to the position illustrated in FIG. 4.

As best viewed in FIGS. 6–7, the lower frame portion 34 includes slot means 94 and reinforcement means 96 for providing increased lateral stability and increased resistance to tortional forces upon blade 50. It will be seen in FIGS. 6–7 that slot 94 is adapted to receive the rear portion 50A of the blade 50 to resist twisting or tortional forces. Additionally, a pair of elongated rigid reinforcement plates of generally L-shaped profile 97 and 98 may be provided at opposite sides of the slot so that the upright generally vertical portions (as viewed in FIG. 7) 97A and 98A respectively sandwich blade portion 50A therebetween to further resist lateral or tortional forces thereby resulting in a stronger blade structure. Additional strength or resistance to tortional forces is achieved from a generally C-shaped standoff 100 which surrounds the slot 94 and which is bolted on opposite sides of the slot to reinforcement plates 97, 98 and frame channel 34. Nut and bolt combinations 101 and 102 as best seen in FIG. 7 attach standoff 100 and plates 97, 98 to frame channel portion 34. As viewed in FIGS. 1, and 3–4 standoff 100 is adapted to prevent contact between the stern of the boat 10 and the trolling fin 20. When the leading rear edge 50A of the trolling fin blade 50 is received through slot 94 and sandwiched between reinforcement plates 97 and 98 it will be apparent that resistance of the trolling fin to tortional or twisting forces is greatly increased, so that lateral drift of the vessel rear will be minimized when operating with an electric trolling motor.

Operation of the device may best be understood by referring to FIGS. 1–4. In FIG. 1 the blade 50 is deployed within water 11 to resist drift of the vessel stern 16. FIG. 3 illustrates the invention in an intermediate position between the deployed position illustrated in FIG. 1 and the transport position illustrated in FIG. 4. It will be apparent that in order to facilitate removal or adjustment of the blade 50 a cable 104 extending between an appropriate orifice 106 defined within the blade 50 and the bearing structure 80 at the upper apex 54 of the frame has been provided. Cable 104 may be grasped by the hand 106 (FIG. 3) of the fisherman in order to easily move the blade into the desired position. As the blade is swung rearwardly over the frame into the stern cargo area (FIG. 4) it will be apparent that the upper linkage section 60 must be of a length 88 substantially equal to the length 90 of the upper hook portion 36 so that the lower linkage portion 62 may fold within the vessel stern without contacting either handle 44 or the frame 32. In this manner the trolling fin blade may be quickly removed from the deployed position to a convenient storage position which will not interfere with casting or other fishing activities. It will also be readily apparent that through the employment of the bearing structure already discussed, if the blade 50 comes into accidental contact with an underwater obstacle 108 (FIG. 1) it will quickly dislodge itself from the frame channel 34 so that damage will not occur. Although the invention is extremely flexible insofar as the latter longitudinal forces are concerned, as mentioned previously the construction employed and illustrated herein facilitates extremely increased resistance to tortional or other twisting forces which might otherwise interfere with the lateral stabilizing affects of the apparatus.

From the foregoing, it will be seen that this invention is one well adapted to attain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A drift resisting trolling fin comprising:

a generally J-shaped, frame adapted to be rigidly secured to a boat, said frame including an upper hook portion of predetermined length attachable over a transom and a vertical channel portion extending downwardly from said hook portion and adapted to be positioned adjacent a stern of said boat;

linkage means pivotally secured to said frame and snugly receivable within said channel portion, said linkage means including:

a first linkage section having a length substantially equal to or greater than said frame hook portion; and a second linkage section pivotally coupled to said first linkage section;

blade means rigidly secured to said second linkage section for selective deployment in either an operable position in water or in an inoperable position substantially within said boat; and frame slot means defined within said frame channel portion for receiving at least a portion of said blade means when in an operable position for reinforcing said trolling fin against twisting forces.

2. The combination as defined in claim 1 including standoff means secured to said frame channel portion for securing said frame a predetermined distance from said stern, said standoff means defining second slot means aligned with said frame slot means for receiving said portion of said blade means to further reinforce said trolling fin against twisting forces.

* * * * *